US008025133B2

(12) United States Patent
De La Pena

(10) Patent No.: US 8,025,133 B2
(45) Date of Patent: Sep. 27, 2011

(54) STRUT SWEDGE TOOLING

(75) Inventor: Oscar De La Pena, Saltillo (MX)

(73) Assignee: Miner Enterprises, Inc., Geneva, IL (US)

( * ) Notice: Subject to any disclaimer, the term of this patent is extended or adjusted under 35 U.S.C. 154(b) by 615 days.

(21) Appl. No.: 12/157,033

(22) Filed: Jun. 6, 2008

(65) Prior Publication Data

US 2009/0301827 A1 Dec. 10, 2009

(51) Int. Cl.
*B61H 13/36* (2006.01)

(52) U.S. Cl. ..... 188/228.1; 188/229.1

(58) Field of Classification Search ..... 188/229.1, 188/228.1; 29/898.054, 898.057, 509; 384/276, 384/279, 295

See application file for complete search history.

(56) References Cited

U.S. PATENT DOCUMENTS

| | | | | | |
|---|---|---|---|---|---|
| 430,756 | A | | 6/1890 | Robischung | |
| 800,409 | A | | 9/1905 | Sharp | |
| 1,106,765 | A | * | 8/1914 | Williams | 188/226.1 |
| 1,943,271 | A | | 1/1934 | Ivermeyer | |
| 2,047,732 | A | | 7/1936 | Harbert | |
| 2,364,021 | A | | 11/1944 | Flesch | |
| 2,398,917 | A | | 4/1946 | Busch | |
| 2,525,775 | A | * | 10/1950 | Cottrell | 188/222.6 |
| 2,547,860 | A | | 4/1951 | Flesch | |
| 2,570,202 | A | | 10/1951 | Busch | |
| 2,808,133 | A | * | 10/1957 | Busch | 188/225.6 |
| 2,930,329 | A | | 3/1960 | Busch | |
| 3,690,270 | A | | 9/1972 | Gutmann, Jr. et al. | |
| 4,194,599 | A | | 3/1980 | Cole | |
| 4,787,129 | A | | 11/1988 | Williamson | |
| 4,831,905 | A | | 5/1989 | Munchinson | |
| 4,956,525 | A | | 9/1990 | Wilk | |
| 5,810,124 | A | | 9/1998 | Sandmann | |
| 6,155,389 | A | | 12/2000 | Sandmann | |
| 6,193,028 | B1 | | 2/2001 | Elizalde-Siller et al. | |
| 6,234,283 | B1 | | 5/2001 | Montes-Ramos | |

(Continued)

OTHER PUBLICATIONS

International Searching Authority/USPTO; International Search Report regarding PCT/US2009/03369; Jul. 24, 2009; 2 pages.

(Continued)

*Primary Examiner* — Bradley King
(74) *Attorney, Agent, or Firm* — Law Office of John W. Harbst

(57) ABSTRACT

A railroad freight car brake beam strut assembly including an elongated strut having first and second joined walls. Each wall of the strut defines a bore opening to a hollow center portion and to an exterior of the strut. The bores defined by the walls on the strut accommodate a brake lever pivot pin extending through strut thereby connecting the brake lever to the strut and so as to allow pivoting of the brake lever. Each bore defined by the walls of the strut has a closed marginal edge. One brake pin bushing is accommodated in each bore defined by the strut so as to journal a lengthwise portion of the brake lever pivot pin. The closed marginal edge of each strut bore arranged in juxtaposed relation relative to the end of the brake pin bushing disposed a farthest distance from the axis of the strut defines a plurality of radially spaced stops formed as an integral part of the strut for inhibiting inadvertent axial displacement of the bushings away from the longitudinal axis of and relative to the strut thereby fixing the pivot axis of said brake lever relative to the strut. A method of manufacturing a railroad freight car brake beam strut assembly is also disclosed.

10 Claims, 7 Drawing Sheets

U.S. PATENT DOCUMENTS

| | | | | |
|---|---|---|---|---|
| 6,543,955 | B2 | 4/2003 | Conaway et al. | |
| 6,935,026 | B2 * | 8/2005 | Frantzen | 29/898.07 |
| 7,077,411 | B2 | 7/2006 | Peters et al. | |
| 2006/0108187 | A1 | 5/2006 | Steffen | |
| 2006/0151261 | A1 * | 7/2006 | Wagner et al. | 188/72.9 |
| 2007/0039783 | A1 | 2/2007 | Doran | |

OTHER PUBLICATIONS

International Searching Authority/USPTO; Written Opinion of the International Searching Authority regarding PCT/US2009/03369; Jul. 24, 2009; 7 pages.

International Searching Authority/USPTO; International Search Report regarding PCT/US2009/03406; Jul. 30, 2009; 2 pages.

International Searching Authority/USPTO; Written Opinion of the International Searching Authority regarding PCT/US2009/03406; Jul. 30, 2009; 8 pages.

International Searching Authority/USPTO; International Search Report regarding PCT/US2009/003372; Jul. 28, 2009; 2 pages.

International Searching Authoirty/USPTO; Written Opinion of the International Searching Authority regarding PCT/US2009/03372; Jul. 28, 2009; 5 pages.

* cited by examiner

STRUT SWEDGE TOOLING

FIELD OF THE DISCLOSURE

The present invention generally relates to railroad freight cars and, more particularly, to a strut assembly for a railroad freight car brake beam assembly and to a method of making same.

BACKGROUND

Railroad freight cars typically include an elongated car body supported toward opposite ends by a pair of wheeled trucks. Each wheeled truck includes a bolster laterally extending between two side frames with a wheel and axle assembly arranged to front and rear sides of the bolster. Each railcar also has a brake system operably associated therewith. A conventional brake system includes a brake beam assembly associated with each wheel and axle assembly and which is connected to brake rigging on the railcar. Each brake beam assembly is supported between the truck side frames to allow it to be operated into and out of braking positions in relation to the respective wheel and axle assembly.

One form of brake beam assembly commonly used in the railcar industry includes a compression member and a tension member arranged in a truss-like configuration with a strut extending therebetween. A brake head, with a replaceable brake shoe, is arranged at each end of the brake beam assembly. It has been found beneficial for the brake beam assembly to maintain both a degree of camber in the compression member and a degree or level of tension in the tension member.

Brake beam assemblies on the railcar are typically operated in simultaneous relation by a power source from a brake cylinder or a hand brake and, through leverage, transmit and deliver braking forces to the brake shoes at the wheels of each wheel and axle assembly. On a typical railcar, brake rigging, including a brake push rod, transmits force, caused by the push of air entering the brake cylinder or by the pull of the hand brake, to the brake shoes.

The brake rigging on the railcar, used to transmit and deliver braking forces to the braking shoes of each wheel assembly, comprises a multitude of linkages including various levers, rods and pins. For example, brake levers are used throughout the brake rigging on each car to transmit as well as increase or decrease the braking force on each wheel and axle assembly A conventional strut on a railroad freight car brake beam assembly has a hollow center with two joined sides or walls, with one side or wall being arranged on opposite sides of a longitudinal axis of the strut. When assembled, the strut is operably connected to the tension and compression members proximate midlength of such members. A conventional brake beam assembly strut has an axially elongated and generally centralized, close-ended slot between the two sides of thereof. Typically, a central portion of a brake lever extends through and is pivotally mounted in the slot between the opposed sides of the strut. Besides being pivotally supported by the strut, opposite ends of the brake lever are articulately connected through suitable connections to the railcar brake rigging. About midlength thereof, the strut defines two openings or bores aligned along an axis extending generally normal to the longitudinal axis of the strut. A pivot pin passes endwise through the bores and through the central portion of the brake lever to define an axis about which the brake lever pivots during railcar operation.

To lower the upper end of the brake lever relative to the position it would occupy if the brake lever were vertical, such brake levers are inclined lengthwise of the brake beam a certain number of degrees, usually about 40°. The strut is designed to accommodate suitable inclination of the brake lever from vertical. To reduce strut wear and to facilitate operation of the brake beam assembly during operation of the railcar, it is known to provide the strut with two brake pin bushings seated in the bores of the strut and which journal the pivot pin for the brake beam.

During use, a railcar can travel tens of thousands of miles between locations and over railbeds, some of which can be in significant disrepair. During railcar travel, the brake lever and related parts of the braking system are subject to vibration and wear. Accordingly, it is not unusual for one or more of the brake pin bushings to unseat from its respective bore and separate from the strut. The inclination of the bushings from vertical, coupled with gravity, also tends to cause at least one of the brake pin bushings to remove itself from the respective bore in the strut. Moreover, current research shows the brake pin bushings are exposed to forces and components of forces acting in a direction working to unseat or displace the brake pin bushings from their respective bore and be driven the out of position relative to the strut.

In some designs, the brake pin bushings are fabricated from a powder sintered metal. Unless powder sintered metal bushings are properly seated within their respective strut bore, such bushings can crack as they become displaced from their respective strut bore. Moreover, and even if such brake pin bushings remain partially seated in the strut bore, the powder sintered metal bushing is prone to chipping. Wear on the brake pin bushings can change the disposition about which the brake lever pivots, thus, changing the pressure exerted by the brake pads to the railcar wheels. Moreover, and under the rules of the American Association of Railroads (the "AAR"), bushing wear and cracking can result in condemnation of the brake beam assembly.

For a myriad of reasons, railroad freight cars are routinely inspected. Part of the inspection process involves an analysis of each railcar brake beam assembly on the railcar. When a particular railroad freight car is identified as having a brake beam assembly requiring repair or replacement, the freight car requiring such repair is usually separated from the remaining cars in the train consist and, then, moved to a facility where such repairs can be affected. Only after a suitable repair facility has been identified and becomes available, can replacement of a condemned brake beam assembly be affected.

Replacing a railcar brake beam assembly, for whatever reason, can be a time consuming process. Moreover, the valuable time lost in separating the railcar with the condemned brake beam from the remaining cars in the train consist, coupled with the time lost in scheduling a repair facility to accomplish replacement of the brake beam assembly, and the valuable time lost in affecting the repair or replacement of the condemned brake beam, along with the time lost in having to move the car with the condemned brake beam to the repair facility for replacement of the brake beam assembly are other considerations and unrealized costs involved with replacing a condemned brake beam. Of course, during this entire time period, the railcar is removed from service. Replacement of the condemned brake beam must also include the time lost in joining the repaired car to a train consist directed toward the original destination of the repaired car.

Thus, there is a continuing need and desire for a strut assembly for a railroad freight car brake beam assembly designed to inhibit inadvertent axial shifting of brake pin bushings in a direction away from the axis of the strut assembly thereby reducing the likelihood of damage to the brake pin bushing and thereby reducing the time and expense the railcar can be out of service due to a faulty brake beam assembly.

SUMMARY

In view of the above, and in accordance with one aspect, there is provided a railroad freight car brake beam strut assembly including an elongated strut defining a longitudinal axis and having a hollow center with an axially elongated slot between first and second joined walls of the strut. The slot in the strut is inclined a predetermined number of degrees from vertical for accommodating an elongated brake lever extending through the strut. Each side or wall of the strut defines a bore opening to the slot and to an exterior of the strut. The bores defined by the walls on the strut are aligned relative to each other to accommodate a lengthwise portion of a brake lever pivot pin extending through the strut thereby connecting the brake lever to the strut and so as to define an axis about which the brake lever pivots. Each bore defined by the walls of the strut has a closed marginal edge. A pair of bushings are also provided with one bushing being accommodated in each bore defined by the strut so as to journal the brake lever pivot pin. Each bushing has first and second axially spaced ends. The closed marginal edge of each bore, defined by said strut and arranged in juxtaposed relation relative to the end of the bushing disposed a farthest distance from the axis of the strut, defines a plurality of radially spaced stops formed as integral part of the strut for inhibiting inadvertent axial displacement of the bushings away from the longitudinal axis of and relative to the strut thereby fixing the pivot axis of the brake lever relative to the strut.

Preferably, each brake pin bushing is sized relative to the bore in the strut such that an interference fit is established between a periphery of the bushing and an inside diameter of the bore defined by the strut. In one embodiment, each brake pin bushing is formed from powdered sintered metal material.

In a preferred form, the closed marginal edge of each bore defines at least three radially spaced stops formed as integral part of the strut for inhibiting inadvertent axial displacement of each bushing away from the longitudinal axis of and relative to the strut thereby fixing the pivot axis of the brake lever relative to the strut. Preferably, the end of the bushing disposed a farthest distance from the axis of the strut is configured to cooperate with and accommodate the plurality of radially spaced stops formed as integral part of the strut.

According to another aspect, there is provided a method of manufacturing a railroad freight car brake beam strut assembly including the step of: providing a railroad freight car brake beam strut having a hollow center along with an axially elongated slot defined between first and second joined side walls thereof, with each side wall of the strut defining a bore opening to the slot and to an exterior of the strut, and with the bores defined by the strut being aligned relative to each other along an axis extending generally normal to a longitudinal axis of the strut. According to this aspect the method of manufacturing the railroad freight car brake beam strut assembly also includes the step of: pressing a brake pin bushing into each bore of the strut until radially spaced portions of a marginal edge of each strut bore arranged in juxtaposed relation relative to an end of the bushing disposed a farthest distance from the axis of the strut are displaced so as to form stops for inhibiting inadvertent axial displacement of the brake pin bushings away from the longitudinal axis of and relative to the strut.

Preferably, the method of manufacturing a railroad freight car brake beam strut assembly includes the further step of: sizing the outer diameter of each bushing relative to an inner diameter of each strut bore such that an interference fit is established as each brake pin bushing is pressed into a respective strut bore. The method of manufacturing a railroad freight car brake beam strut assembly preferably includes the further step of: forming each brake pin bushing from a powdered sintered metal material.

Alternatively, the method of manufacturing the railroad freight car brake beam strut assembly involves the further step of: configuring an end of each brake pin bushing, disposed a farthest distance from the axis of said strut, so as to cooperate with and accommodate the plurality of radially spaced stops formed as integral part of the strut. Preferably, the method of manufacturing the railroad freight car brake beam strut assembly includes the further step of: piloting a free end of a tool used to press the brake pin bushings into each bore of the strut into operable combination with each brake pin bushing.

In a most preferred form, the method of manufacturing the railroad freight car brake beam strut assembly includes the further step of: using a single and continuous operation for pressing each brake pin bushing into the respective bores on the strut and for forming the radially spaced portions from a marginal edge of each strut bore so as to form stops for inhibiting inadvertent axial displacement of said bushings away from the longitudinal axis of and relative to said strut. Preferably, the method of manufacturing the railroad freight car brake beam strut assembly also involves the step of: forming at least three radially spaced portions from a marginal edge of each strut bore so as to form at least three stops for inhibiting inadvertent axial displacement of the brake pin bushings away from the longitudinal axis of and relative to the strut.

DETAILED DESCRIPTION OF THE DRAWINGS

DETAILED DESCRIPTION

Figure 1:
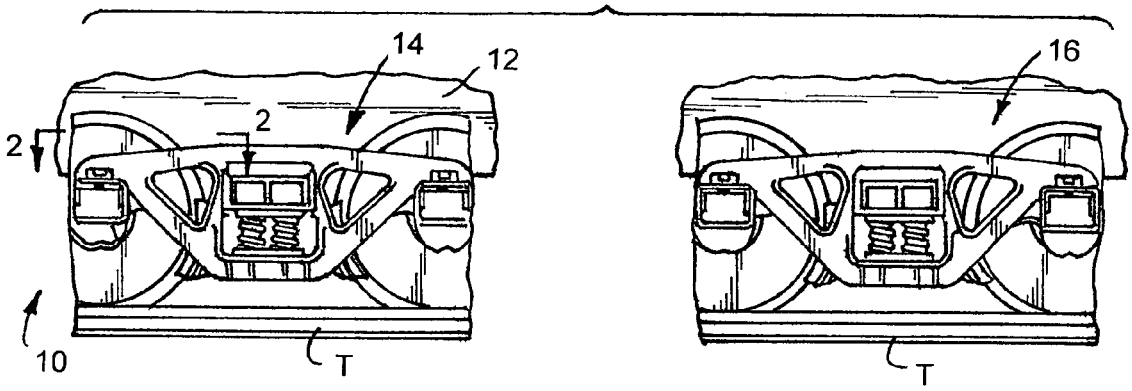
FIG. 1 is a fragmentary side elevational view of a railroad car having railroad car trucks arranged toward opposite ends thereof.

While the present disclosure is susceptible of embodiment in multiple forms, there is shown in the drawings and will hereinafter be described preferred embodiments of the disclosure, and the present disclosure is to be considered as setting forth exemplifications which are not intended to limit the disclosure to the specific embodiments illustrated and described.

Referring now to the drawings, wherein like reference numerals indicate like parts throughout the several views, FIG. 1 shows a railroad freight car 10 including a car body 12. Typically, the car body 12 is supported, toward opposite ends thereof, in operable combination with a pair of wheeled trucks 14 and 16 for movement over tracks T. The wheeled trucks 14, 16 are substantially similar to each other and, thus, only wheeled truck 14 will be discussed in detail.

Figure 2:
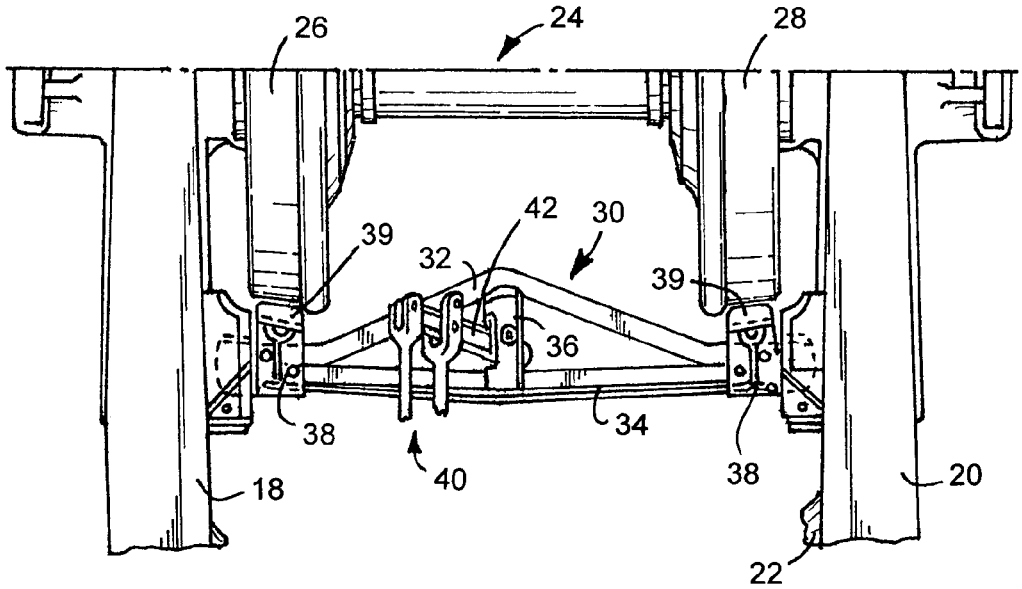
FIG. 2 is a fragmentary plan view of a brake beam assembly associated with one of the railroad car trucks shown in FIG. 1.

As shown in FIG. 2, each wheeled truck includes a pair of side frames 18 and 20 with a bolster 22 extending laterally therebetween and upon which car body 12 (FIG. 1) is pivotally supported. The side frames 18, 20 are usually of one-piece construction and formed from cast steel. Although only one is partially shown in FIG. 2, those skilled in the art will appreciate a conventional wheel and axle assembly 24 is provided on each side of the bolster 22 between the side frames 18, 20 and in operable combination with each truck. As is typical, each wheel and axle assembly 24 includes a pair of laterally spaced and flanged wheels 26 and 28.

Each wheel and axle assembly 24 on railcar 10 has a brake beam assembly 30 arranged in operable combination therewith. In the illustrated embodiment, the side frames 18, 20 on each truck conventionally guide and support the brake beam assembly 30 for generally horizontal sliding movements. As shown in FIG. 2, a conventional brake beam assembly 30 includes several interrelated components including a tension member 32, a compression member 34, and a strut assembly 36. In the illustrated embodiment, the tension member 32 and compression member 34 are arranged in a truss-like configuration and laterally extend between the two side frames 18 and 20 for guided movements.

Typically, each brake beam assembly 30 has a brake head 38 with friction brake shoes 39 disposed toward opposed ends thereof for engagement with the respective wheels 26, 28 of an associated wheel and axle assembly. The brake shoes 39 are moved into and out of braking relation with the wheels 26, 28 of a respective wheel and axle assembly through brake rigging, generally identified in FIG. 2 by reference numeral 40, which is responsive to operation of an air cylinder (not shown) or a hand brake mechanism (not shown).

The strut assembly 36 shown in FIG. 2 is generally centralized along the lengths of and is operably connected toward opposite ends to the tension member 32 and compression member 34 in a conventional manner. In operation, strut assembly 36 holds member 34 to its camber and member 32 to its bowed shape. A brake lever 42 forming part of the brake rigging 40 is fulcrumed intermediate opposite ends thereof in each strut assembly 36.

Figure 3:
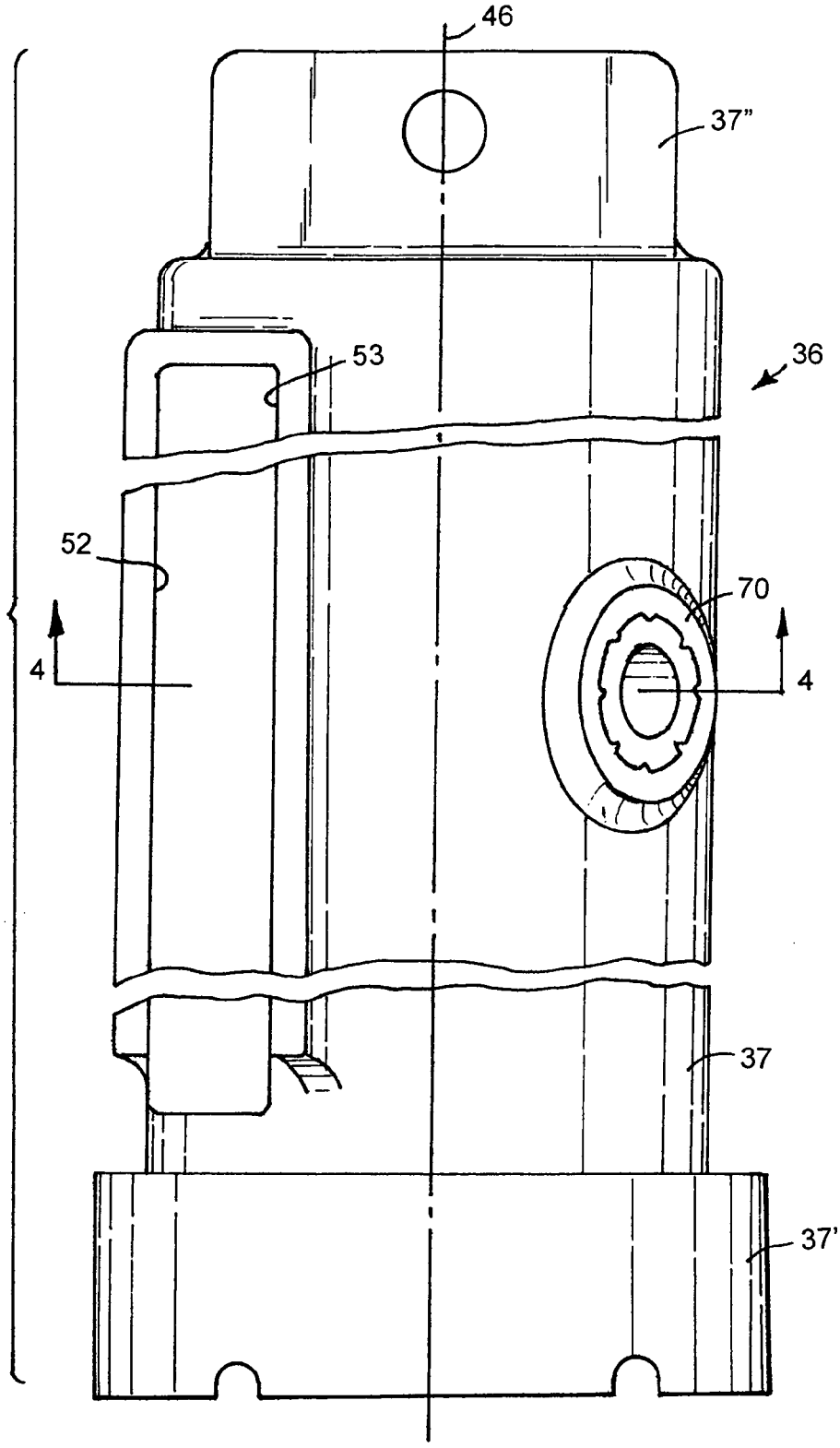
FIG. 3 is an enlarged plan view of a brake beam strut assembly embodying principals of the present disclosure.

As shown in FIG. 3, strut assembly 36 has an elongated axis 46 and includes an elongated strut 37 having a hollow center portion and defining an elongated slot 52 with a closed margin 53. Slot 52 in strut 37 allows the brake lever 42 (FIG. 4) to extend endwise through the strut 36. Strut 37 furthermore has a first end 37' configured for suitable attachment to the tension member 32 and second end 37" configured for suitable attachment to compression member 34.

Figure 4:
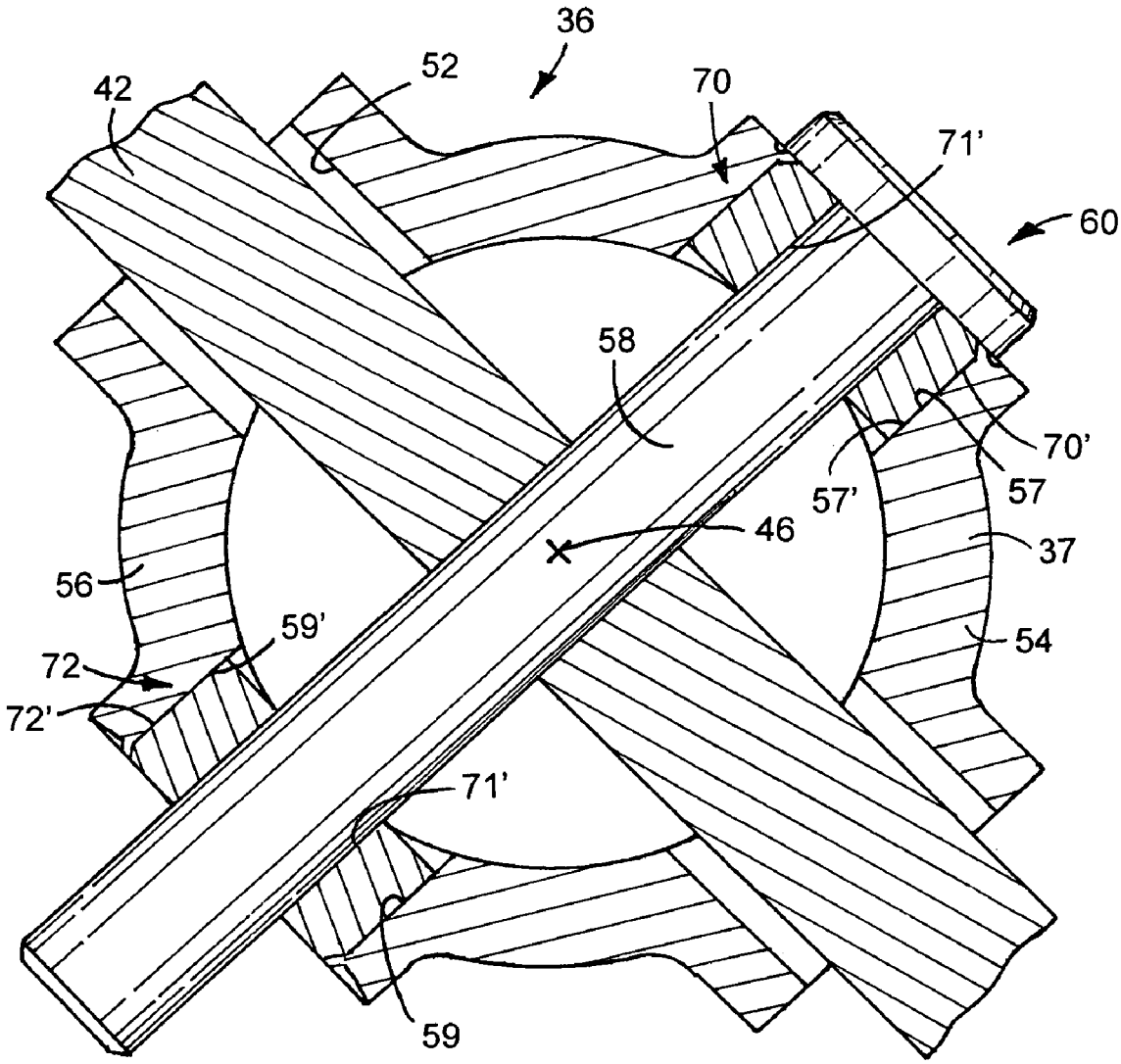
FIG. 4 is sectional view taken along line 4-4 of FIG. 3.

As shown in FIG. 4, strut 37 includes first and second generally parallel and joined sides or side walls 54 and 56 disposed to opposite sides of the longitudinal axis 46 and defining the slot 52 therebetween. To lower the upper end of brake lever 42, and after the strut assembly 36 is operably connected to member 32 and member 34 (FIG. 2), slot 52 is inclined a predetermined number of degrees from vertical. In one embodiment, and after strut assembly 36 is operably connected to members 32 and 34, slot 52 is inclined about 40° from vertical.

As shown in FIG. 4, each side wall 54 and 56 of the strut 37 defines a bore 57 and 59, respectively. Each bore 57, 59 has a closed marginal edge. Moreover, each bore 57, 59 opens to the hollow interior and to an exterior of the strut 37. The bores 57, 59 defined by strut 37 are aligned relative to each other along an axis 58 and accommodate a lengthwise portion of a brake lever pivot pin 60 extending through the strut 37. Preferably, axis 58 defined by the bores 57, 59 extends generally normal to and preferably intersects with axis 46 of strut 37. Pin 60 is arranged in generally coaxial alignment with axis 58 and serves to connect the brake lever 42 to the strut assembly 36 so as to allow the brake lever 42 to pivot about axis 58 during operation of the brake beam assembly 30.

To reduce wear on the strut 37 resulting from continuous pivoting movements of the brake lever 42 during operation of the brake beam assembly 30, strut assembly 36 further includes a pair of brake pin bushings 70 and 72. To reduce manufacturing costs for the strut 37, bushings 70, 72 are preferably identical in design relative to each other. Bushings 70 and 72 are accommodated in the bores 57 and 59, respectively, of the strut 37 so as to journal that lengthwise portion of the brake lever pivot pin 60 extending through the brake pin bushings 70, 72. In a preferred form, the brake pin bushings 70 and 72 are fabricated from a sintered powdered material.

As shown in FIG. 4, the bores 57 and 59 in the brake beam assembly strut 37 each have an inner diameter 57' and 59', respectively. Preferably, each brake pin bushing 70, 72 has a generally cylindrical outer periphery and, thus, an outer diameter 70' and 72', respectively. Preferably, the outer diameter 70', 72' of the respective brake pin bushings 70, 72 are sized such that an interference fit is established between the outside diameter 70', 72' of each brake pin bushings 70, 72 and the inner diameter 57', 59' of the respective strut bores 57, 59 into which the brake pin bushings 70, 72 are pressed. In one form, the outer diameter 70', 72' of the brake pin bushings 70, 72 initially ranges in size to be about 0.004 to about 0.018 inches larger in diameter than the inner diameters 57', 59' of the bores 57, 59. In a most preferred form, the outer diameter 70', 72' of each brake pin bushings 70, 72 is initially about 0.013 inch larger than are the inner diameters 57', 59' of the bores 57, 59. An inner diameter 71' of each brake pin bushing 70, 72 is sized to journal that portion of the brake pin 60 passing therethrough for rotation about axis 62.

Figure 5:
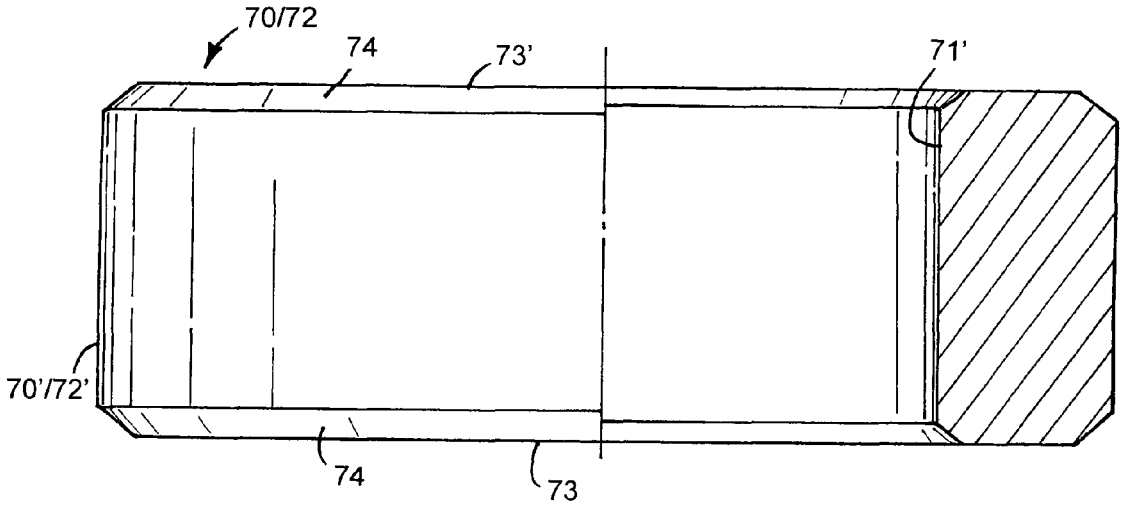
FIG. 5 is an enlarged view, partially in section, of a brake pin bushing.

As shown in FIG. 5, each brake pin bushing 70, 72 has a first or inner end 73 and an axially spaced second or outer end 73'. Preferably, and as shown in FIG. 4, the spacing between the first and second ends 73, 73', respectively, of each bushing 70, 72 is generally equal to or slightly less than the thickness or width (i.e. the measurable distance between interior and exterior surfaces of the strut in the area through which the strut bore extends) of the respective walls 54, 56 of the strut 37.

As shown in FIG. 5, each end 73 and 73' of each brake pin bushing 70, 72 is preferably configured with a suitable chamfer or angled surface 74 thereon. The chamfer or beveled surface 74 provided at the end 73' of each brake pin bushing facilitates insertion of the brake pin bushing into the respective strut bore. As discussed below, the chamfer or beveled surface 73' provided at the end of each brake pin bushing is furthermore designed to cooperate with suitable instrumentalities on the strut 37 for inhibiting inadvertent axial displacement of either brake pin bushing away from the longitudinal axis 46 of the strut 37 (FIG. 6).

Figure 6:
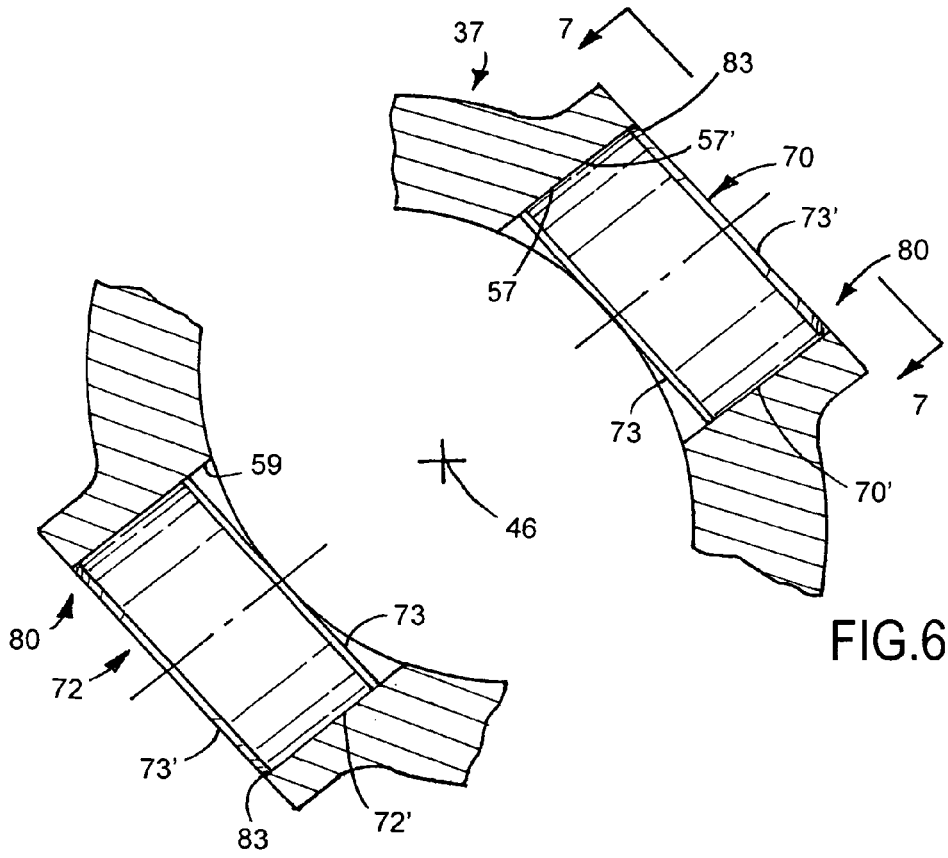
FIG. 6 is a fragmentary sectional view showing the brake pin bushings inserted into operable combination with the brake beam strut.

To inhibit inadvertent axial displacement of either brake pin bushing away from the longitudinal axis 46, strut 37 further includes a stop, generally identified by reference numeral 80 in FIG. 6 operably associated with each brake pin bushing 70, 72. Since the brake pin bushings 70, 72 are identical, only the stop 80 associated with brake pin bushing 72 will be discussed in detail.

Figure 8:
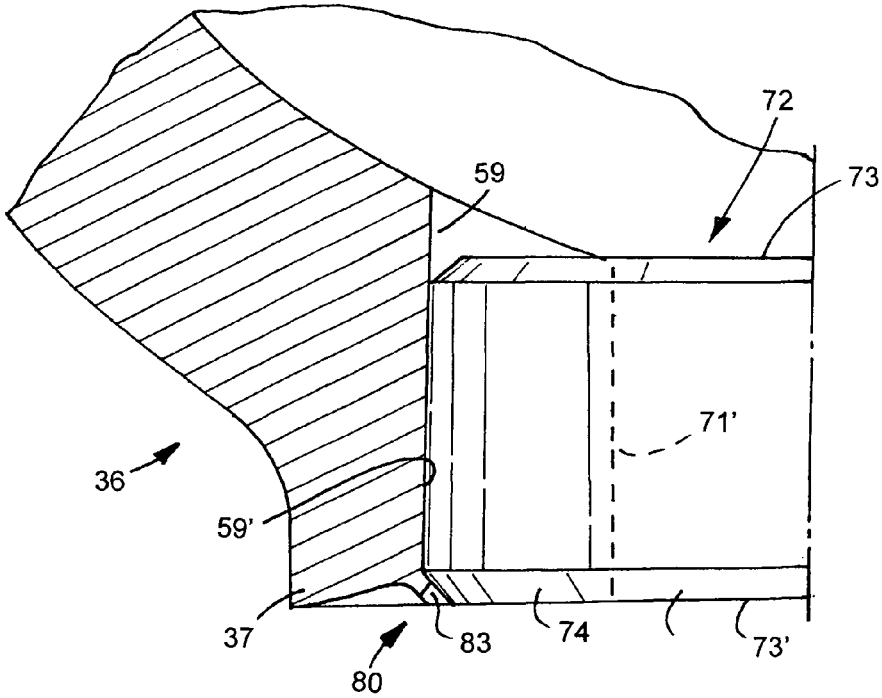
FIG. 8 is fragmentary sectional view of that area of a brake pin bushing encircled in phantom lines in FIG. 4.
Figure 7:
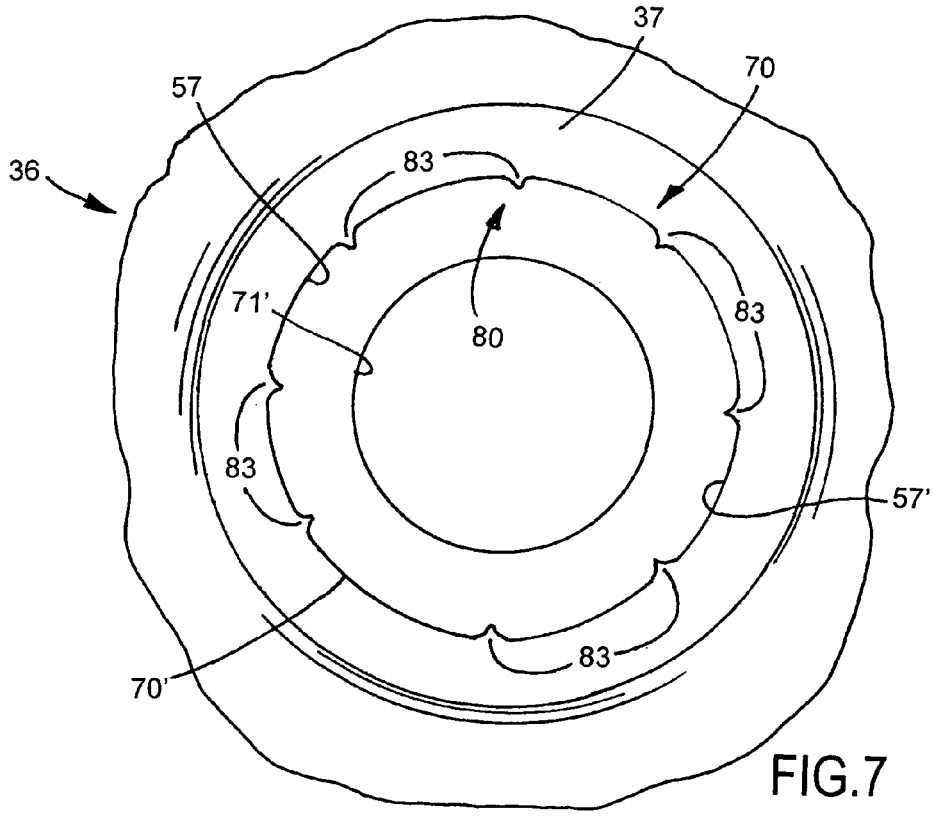
FIG. 7 is a plan view taken along line 7-7 of FIG. 6

As shown in FIGS. 6, 7 and 8, the stop 80 associated with each brake pin bushing is formed from material 83 from which the strut 37 is formed. The material 83 forming stop 80 is arranged in juxtaposed or upset relation with that end 73' of the brake pin bushing disposed farthest from the longitudinal axis 46 of the strut 37 (FIG. 6). The upset material 83 operably and effectively reduces the inner diameter of the respective strut receiving bore at that end thereof opening to the exterior of the strut thereby inhibiting inadvertent axial displacement of the respective brake pin bushing therepast and away from the longitudinal axis 46 of the strut 37.

In the illustrated example shown in FIG. 7, the upset material 83 is preferably arranged in three to eight regions about the closed marginal edge of the strut bore accommodating the brake pin bushing. Preferably, and as shown in FIG. 8, the angled or chamfer configuration 74 at the outer or second end 73' of each brake pin bushing cooperates with and accommodates the upset material 83 formed as an integral part of the strut 37. Of course, the marginal edge of the brake pin bushing receiving bore defined by the strut can have more or less than three to eight regions of upset material without detracting or departing from the spirit and scope of the present disclosure. In a preferred embodiment, and to accomplish the desired ends, each brake pin bushing is pressed into the respective bore of the strut until radially spaced portions of the marginal edge of the respective strut bore, arranged in juxtaposed relation to the outer end of the respective brake pin bushing disposed the farthest distance from the axis 46 of the strut 37, are displaced so as to form the stops 80 whereby inhibiting inadvertent axial displacement of the brake pin bushing in a direction away from the axis 46 of the strut 37 (FIG. 6).

Figure 9:
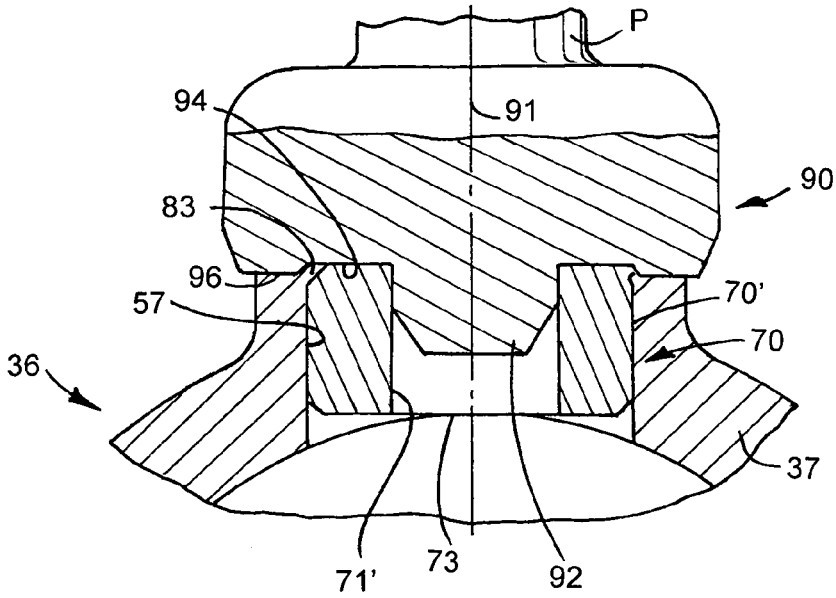
FIG. 9 is a side elevational view, partially in section, showing insertion of brake pin bushing into operable combination with a brake beam strut.

As shown in FIG. 9, a tool 90 connected to a suitable press P is preferably used to: 1) press the respective brake pin bushings 70, 72 into their respective strut bores 58, 59 (FIG. 6); and, 2) upset material about the closed marginal edge of each strut bore 58, 59. In a most preferred form, pressing of each brake pin bushing 70, 72 into their respective strut bore 57, 59 and upsetting the material about the closed edge of each strut bore 58, 59 is accomplished during a single progressive operation.

As shown in FIG. 9, tool 90 has an axis 91 and is preferably configured with an axially elongated pilot portion 92. The pilot portion 92 of tool 90 is configured to fit axially within the inner diameter 71' of each brake pin bushing thereby aligning tool 90 and the brake pin bushing relative to each other. Axially spaced from the distal end of the pilot portion 92, tool 90 is provided with a generally flat portion 94 radially extending outwardly from the pilot portion and axis 91. The generally flat portion 94 of tool 90 is configured to engage and press against the second or outer end 73' of each brake pin bushing 70, 72 as each brake pin bushing is pressed into their respective bore 57, 59 defined by strut 37.

Figure 10:
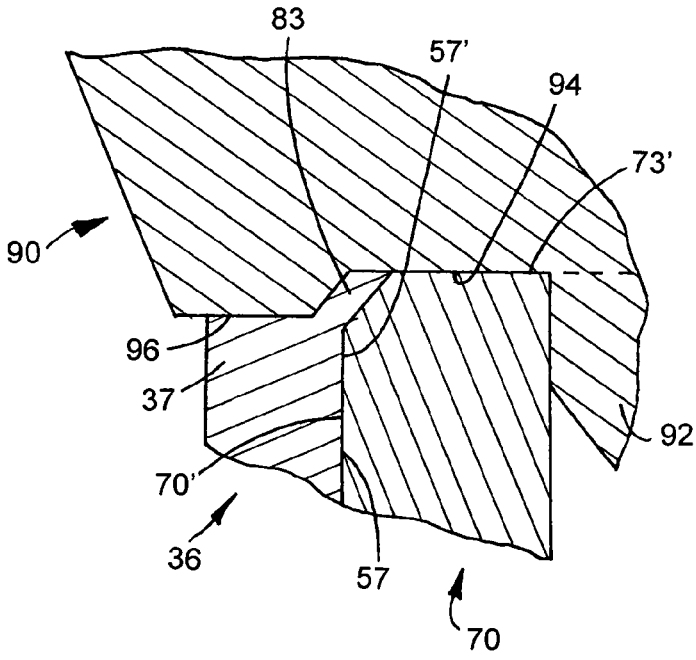
FIG. 10 is a fragmentary and enlarged view of that area of a brake pin bushing encircled in FIG. 9.
Figure 11:
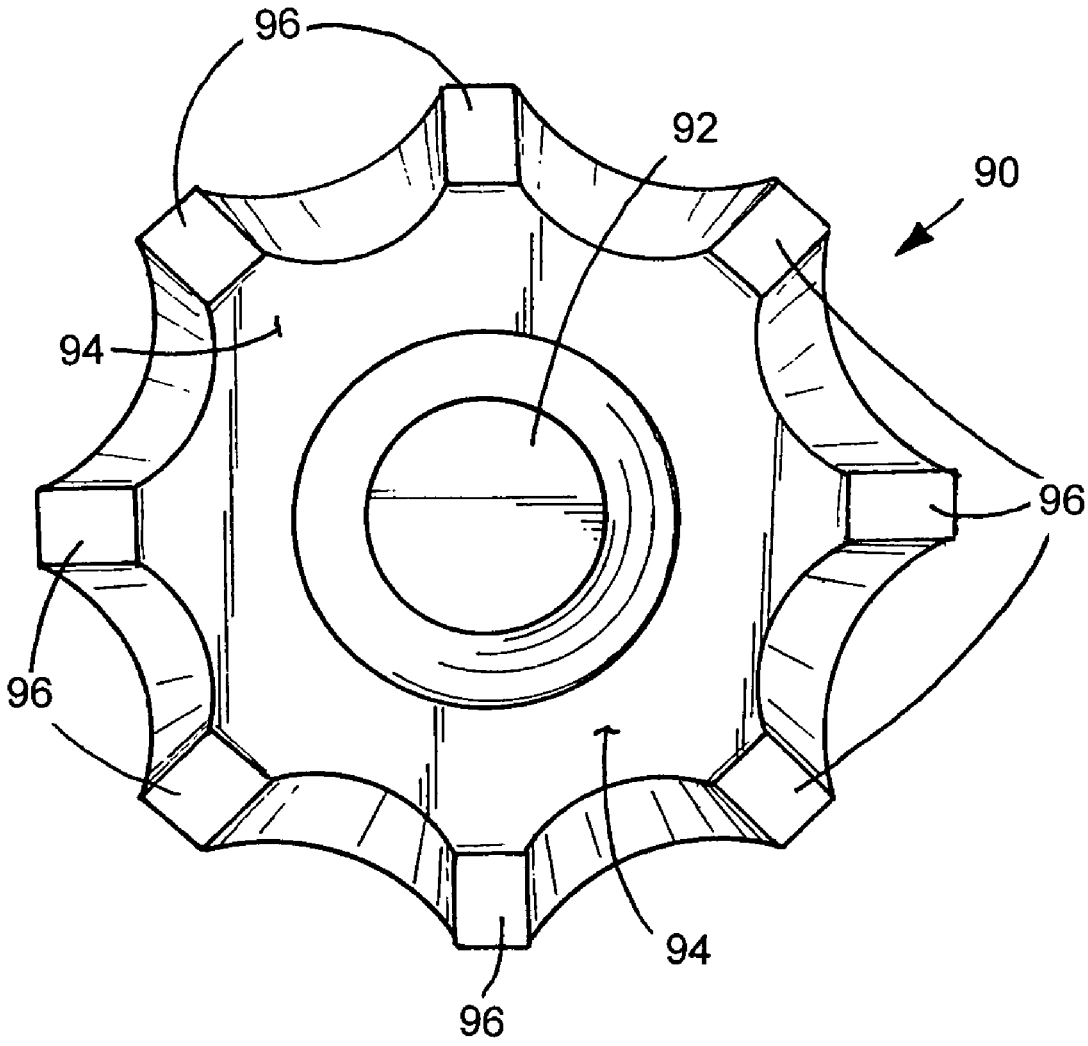
FIG. 11 is bottom plan view of one form of tool used to insert the brake pin bushing into operable combination with the brake beam strut.

As shown in FIGS. 9, 10 and 11, tool 90 is furthermore provided with a series of radially disposed teeth or projections 96 arranged in predetermined radial relation relative to the outer diameter 70', 72' of each bushing 70, 72, respectively, and the outer diameter of each bore 58, 59 defined by strut 37. The teeth or projections 96 depend from the generally flat portion 94 of tool 90 and, as shown in FIG. 9, are configured to upset material disposed about the closed and outer marginal edge of each strut opening 57, 59 after the respective brake pin bushing is axially inserted into the respective strut bore. The number of teeth or projections 96 on the tool 90 used to upset material preferably correspond to the number of regions about the closed marginal edge of the strut bore defining the upset material 83. Moreover, the number of teeth and, thus, the number of regions of upset material 83 are equally disposed relative to each other whereby allowing the regions of upset material to cooperate with each other in preventing inadvertent axial displacement of the brake pin bushings in a direction away from the axis 46 of the strut 37 (FIG. 6) thereby fixing the pivot axis of said brake lever 42 relative to the strut 37.

There is also provided a method of manufacturing a railroad freight car brake beam strut assembly 36 including the step of: providing a railroad freight car brake beam strut 37 having a hollow interior and an axially elongated slot 52 defined between first and second sides or walls 54 and 56 thereof. Each side or wall 54, 56 defines a bore 57, 59, respectively, opening to the hollow interior and to an exterior of the strut 37. The bores 57, 59 defined by strut 37 are preferably aligned relative to each other along an axis 58 extending preferably normal to and, in a most preferred embodiment, intersecting with the longitudinal axis 46 of the strut 37. According to this aspect, the method of manufacturing the railroad freight car brake beam strut assembly 36 also includes the step of: pressing a brake pin bushing 70, 72 into each bore 57, 59 of the strut 37 until radially spaced portions of a marginal edge of each strut bore 57, 59, arranged in juxtaposed relation relative to an end of the bushing 70, 72 disposed a farthest distance from the axis 46 of the strut 37 are displaced so as to form stops 80 for inhibiting inadvertent axial displacement of the brake pin bushings 70, 72 away from the longitudinal axis 46 of and relative to the strut 37.

Preferably, the method of manufacturing a railroad freight car brake beam strut assembly 36 includes the further step of: sizing the outer diameter 70', 72' of each brake pin bushing 70, 72, respectively, relative to an inner diameter 57', 59' of each strut bore 57, 59 such that an interference fit is established as each brake pin bushing 70, 72 is pressed into a respective strut bore 57, 59. The method of manufacturing a railroad freight car brake beam strut assembly preferably includes the further step of: forming each brake pin bushing 70, 72 from a powdered sintered metal material.

Alternatively, the method of manufacturing the railroad freight car brake beam strut assembly 36 involves the further step of: configuring an end 73' of each brake pin bushing 70, 72, disposed a farthest distance from the axis 46 of the strut 37, so as to cooperate with and accommodate the plurality of radially spaced stops 80 formed as integral part of the strut 37. Preferably, the method of manufacturing the railroad freight car brake beam strut assembly includes the further step of: piloting a free end of a tool 90 used to press the brake pin bushings 70, 72 into each bore 57, 59 of the strut 37 into operable combination with each brake pin bushing 70, 72.

In a most preferred form, the method of manufacturing the railroad freight car brake beam strut assembly 36 includes the further step of: using a single and continuous operation for pressing each brake pin bushing 70, 72 into the respective bores 57, 59 on the strut 37 and for forming the radially spaced stops 80 from a marginal edge of each strut bore 57, 59 so as to inhibit inadvertent axial displacement of the brake pin bushings 70, 72 away from the longitudinal axis 46 of and relative to the strut 37. Preferably, the method of manufacturing the railroad freight car brake beam strut assembly 36 also involves the step of: forming at least three radially spaced stops from a marginal edge of each strut bore 57, 59 so as to inhibit inadvertent axial displacement of the brake pin bushings 70, 72 away from the longitudinal axis 46 of and relative to the strut 37.

Although the brake pin bushings are inclined a predetermined number of degrees from vertical, the stops 80 associated with each brake pin bushing serve to limit inadvertent axial displacement of the brake pin bushings 70, 72 away from the centerline 46 of the brake beam assembly strut 37. As such, the brake pin bushings 70, 72 are each maintained in operable combination with the strut 37 thereby providing enhanced performance for the brake beam assembly. Moreover, the ability to maintain the brake pin bushings 70, 72 in operable combination with the strut 37 while inhibiting axial shifting of the brake pin bushings away from the centerline 46 of the strut 37 offers enhanced durability to the bushings 70, 72 at a minimal cost. Additionally, the ability to maintain the brake pin bushings 70, 72 in operable combination with the strut 37 while limiting the axial displacement of the brake pin bushings 70, 72 away from the centerline 46 of the strut 47 during brake operation provides the brake lever 42, pivoting about the brake pin 60 journalled by the bushings 70, 72, with a relatively constant axis about which to pivot thereby offering consistent performance of the brake beam assembly during operation. These and other objects, aims and advantages of the present disclosure are all provided with minimal costs and simplistic design changes.

From the foregoing, it will be observed that numerous modifications and variations can be made and effected without departing or detracting from the true spirit and novel concept of the present invention disclosure. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed:

1. A brake beam strut assembly on a railroad freight car, with said strut assembly comprising:

an elongated strut including an axially elongated body defining a longitudinal axis and having an exterior, with the body of said strut also defining an axially elongated slot between first and second walls of the body of said strut, with the slot in said strut body being inclined a predetermined number of degrees from vertical for accommodating an elongated brake lever extending through said strut, with each side wall of said strut defining a bore opening to the slot and to an exterior of the body of said strut, with the bores defined by the walls on said strut body being aligned relative to each other, and wherein each bore defined by the walls of the strut body has a closed marginal edge;

a pair of brake pin bushings, with one brake pin bushing being accommodated in each bore defined by the strut body, and with each brake pin bushing having an inner end and an outer end, with the inner end of each brake pin bushing, after each bushing is inserted into operable combination with the strut body, being disposed closest to the longitudinal axis of the strut body, and with the outer end of each bushing having a planar surface extending generally coplanar with a portion of the strut body exterior defining the closed marginal edge of the bore after each brake pin bushing is inserted into operable combination with the strut body, and with the outer end of each brake pin bushing defining an annular chamfer extending thereabout;

a brake lever pivot pin for pivotally connecting a brake lever to said strut assembly while defining a pivot axis for a brake lever relative to said strut assembly, with said brake lever pivot pin having an elongated shank portion and an enlarged head portion, with the shank portion of said pivot pin extending endwise through and is journaled by the brake pin bushings, and with the enlarged head portion of said pivot pin having a diameter generally equal to a diameter of each brake pin bushing such that, after said pivot pin is arranged in operable combination with the bushings, the enlarged head portion of said pivot pin is arranged in rotational confronting relation relative to the planar surface at the outer end of one of said brake pin bushings; and wherein the closed marginal edge of each bore defined by said strut body is arranged in juxtaposed relation relative to the outer end of each brake pin bushing and defines a plurality of radially spaced stops formed as integral part of the strut for inhibiting inadvertent axial displacement of said bushings away from the longitudinal axis of and relative to said strut thereby fixing the pivot axis of said brake lever relative to said strut, and with each stop cooperating with and is accommodated by the annular chamfer at the second outer end of said brakepin bushing such that no substantial portion of any stop extends beyond the planar surface at the outer end of each brake pin bushing so as to limit adverse wear being imparted to said stops by rotational movements of said enlarged head of said brake lever pivot pin relative to the respective brake pin bushing.

2. The brake beam strut assembly according to claim 1, wherein each brake pin bushing is sized relative to the bore in said strut such that an interference fit is established between a periphery of said brake pin bushing and an inside diameter of the bore defined by said strut.

3. The brake beam strut assembly according to claim 1, wherein each brake pin bushing is formed from powdered sintered metal material.

4. The brake beam strut assembly according to claim 1, wherein the closed marginal edge of each bore defines at least three radially spaced stops formed as integral part of the strut body for inhibiting inadvertent axial displacement of each brake pin bushing away from the longitudinal axis of and relative to said strut body thereby fixing the pivot axis of said brake lever relative to said strut assembly.

5. A method of manufacturing a brake beam strut assembly for a railroad freight car, comprising the steps of:

providing a railroad freight car brake beam strut having an axially elongated body defining a longitudinal axis for said strut, with the body of said strut having an exterior, and with said strut body further defining an axially elongated slot defined between first and second side walls of said strut body, with each side wall of said strut body defining a bore opening to said slot and to the exterior of said strut body, with the bores defined by said strut body being aligned relative to each other along an axis extending generally normal to a longitudinal axis of said strut;

providing two brake pin bushings, with each brake pin bushing having an inner end and an outer end, with the inner end of each brake pin bushing, after each bushing is inserted into operable combination with the strut body, being disposed closest to the longitudinal axis of the strut body, and with the outer end of each bushing having a planar surface extending generally coplanar with a portion of the strut body exterior defining a closed margin edge of the bore after each brake pin bushing is inserted into operable combination with the strut body, and with the outer end of each brake pin bushing defining an annular chamfer extending thereabout;

providing a brake lever pivot pin for pivotally connecting a brake lever to said strut while defining a pivot axis for said brake lever, with said brake lever pivot pin having an elongated shank portion and an enlarged head portion, with the shank portion of said pivot pin extending endwise through and is journaled by the brake pin bushings, and with the enlarged head portion of said pivot pin having a diameter generally equal to a diameter of each brake pin bushing such that, after said pivot pin is arranged in operable combination with the bushings, the enlarged head portion of said pivot pin is arranged in rotational confronting relation relative to the planar surface at the outer end of one of said brake pin bushings; and pressing each brake pin bushing into each bore of said strut body until radially spaced portions of a marginal edge of the respective bore in the strut body, arranged in juxtaposed relation relative to the outer end of the respective brake pin bushing, are displaced so as to form a plurality of radially spaced stops for inhibiting inadvertent axial displacement of said bushings away from the longitudinal axis of and relative to said strut body, and with each stop cooperating with and is accommodated by the annular chamfer at the outer outer end of said brake pin bushing such that no substantial portion of any stop extends beyond the planar surface at the outer end of each brake pin bushing so as to limit adverse wear being imparted to said stops by rotational movements of said enlarged head of said brake lever pivot pin relative to the respective brake pin bushing.

6. The method of manufacturing a brake beam strut assembly according to claim 5 comprising the further step of:

sizing the outer diameter of each brake pin bushing relative to an inner diameter of each strut bore such that an interference fit is established as each brake pin bushing is pressed into a respective strut bore.

7. The method of manufacturing a brake beam strut assembly according to claim 5 comprising the further step of:

forming each brake pin bushing from a powdered sintered metal material.

8. The method of manufacturing a brake beam strut assembly according to claim 5 comprising the further step of:

piloting a free end of a tool used to press said brake pin bushings into each bore of said strut body into operable combination with each brake pin bushing.

9. The method of manufacturing a brake beam strut assembly according to claim 5 comprising the further step of:

using a single and continuous operation for pressing each brake pin bushing into the respective bores on said strut body and for forming the radially spaced portions from a marginal edge of each strut bore so as to form stops for inhibiting inadvertent axial displacement of said bushings away from the longitudinal axis of and relative to said strut.

10. The method of manufacturing a brake beam strut assembly according to claim 5 comprising the further step of:

forming at least three the radially spaced portions from a marginal edge of each strut bore so as to form at least three stops for inhibiting inadvertent axial displacement of said bushings away from the longitudinal axis of and relative to said strut body.

* * * * *